US010240340B2

(12) United States Patent
Studer et al.

(10) Patent No.: US 10,240,340 B2
(45) Date of Patent: Mar. 26, 2019

(54) DECK MOUNTING SYSTEM

(71) Applicant: Studer Residential Designs, Inc., Cold Spring, KY (US)

(72) Inventors: Paul Studer, Cold Spring, KY (US); Michael Frimming, Cold Spring, KY (US); Michael A. Studer, Wilder, KY (US); Donald Roenker, Taylor Mill, KY (US)

(73) Assignee: Studer Residential Designs Inc., Cold Spring, KY (US)

( * ) Notice: Subject to any disclaimer, the term of this patent is extended or adjusted under 35 U.S.C. 154(b) by 0 days.

(21) Appl. No.: 15/676,269

(22) Filed: Aug. 14, 2017

(65) Prior Publication Data

US 2019/0048577 A1 Feb. 14, 2019

(51) Int. Cl.

| | |
|---|---|
| ***E04B 1/00*** | (2006.01) |
| ***E04B 1/26*** | (2006.01) |
| ***E04B 1/38*** | (2006.01) |
| ***E04B 1/41*** | (2006.01) |

(52) U.S. Cl.

CPC ..... *E04B 1/40* (2013.01); *E04B 1/003* (2013.01); *E04B 1/2604* (2013.01); *E04B 2001/2644* (2013.01); *E04B 2001/405* (2013.01)

(58) Field of Classification Search

CPC ..... E04B 1/40; E04B 1/2604; E04B 1/003; E04B 2001/405; E04B 2001/2644

See application file for complete search history.

(56) References Cited

U.S. PATENT DOCUMENTS

| | | | | |
|---|---|---|---|---|
| 3,890,759 | A * | 6/1975 | Selden | E04B 1/2604 403/217 |
| 4,811,542 | A * | 3/1989 | Jewell | E04B 1/003 248/300 |
| 4,953,339 | A * | 9/1990 | Jewell | E04B 1/003 248/300 |
| 5,513,476 | A * | 5/1996 | Jones | E02D 27/34 52/293.3 |
| 5,611,179 | A * | 3/1997 | Leek | E04B 1/003 403/13 |
| 6,311,449 | B1 | 11/2001 | Morse et al. | |
| 6,427,391 | B1 | 8/2002 | Lyons | |
| 7,419,335 | B1 * | 9/2008 | Cohen | E04G 23/0218 248/351 |
| 7,861,469 | B2 * | 1/2011 | Heady | E04G 23/0229 52/127.2 |
| 8,607,515 | B2 * | 12/2013 | Jarvis | E04B 1/0038 403/258 |

(Continued)

*Primary Examiner* — Rodney Mintz

(74) *Attorney, Agent, or Firm* — Wood Herron & Evans LLP

(57) ABSTRACT

A mounting system for mounting an external structure, such as a deck, with a building includes an anchor frame that couples with structural elements of the building and a bracket that couples with both the external structure and the anchor frame for securement. The anchor frame includes a plate element configured for mounting against a board of a building and anchor elements extending from the plate element and configured for mounting against a second board of a building. The bracket has a first face portion configured for coupling with the anchor frame and a second face portion spaced from the first face portion and configured for mounting with an external structure.

16 Claims, 11 Drawing Sheets

(56) References Cited

U.S. PATENT DOCUMENTS

| | | | | |
|---|---|---|---|---|
| 8,621,802 | B2 | 1/2014 | Spyrou | |
| 8,925,267 | B1 * | 1/2015 | Kirby | E04G 23/0218 248/354.3 |
| 9,045,892 | B2 * | 6/2015 | Smith | E04B 1/003 |
| 9,091,090 | B1 * | 7/2015 | Kirby | E04G 23/0218 |
| 9,194,118 | B2 * | 11/2015 | Spyrou | E04B 1/003 |
| 10,024,046 | B2 * | 7/2018 | Higginbotham | E04B 5/12 |
| 10,060,118 | B2 * | 8/2018 | Callahan | E04B 1/003 |
| 2010/0307094 | A1 * | 12/2010 | Spyrou | E04B 1/003 52/489.1 |
| 2012/0315081 | A1 | 12/2012 | Bouldin et al. | |
| 2013/0139465 | A1 | 6/2013 | Kuryk et al. | |
| 2014/0013701 | A1 | 1/2014 | Rodgers | |
| 2014/0215956 | A1 * | 8/2014 | Smith | E04B 1/003 52/705 |
| 2015/0299999 | A1 | 10/2015 | Koblasz et al. | |
| 2017/0044752 | A1 * | 2/2017 | Higginbotham | E04B 1/003 |
| 2017/0298611 | A1 * | 10/2017 | Callahan | E04B 1/003 |
| 2017/0362816 | A1 * | 12/2017 | Carbary | E04B 1/40 |

* cited by examiner

DECK MOUNTING SYSTEM

FIELD OF THE INVENTION

This invention is related generally to a mounting system and particularly to a system for mounting an external structure to a building.

BACKGROUND OF THE INVENTION

Usually, external structures, such as decks or porches, are built onto a building, such as a house or other dwelling, as a separate structure from the actual building. That is, the deck structure has its own components and structures, including flooring and support structures, that are independent from the building. Those deck structural elements are then connected into some portion of the house or building for securing the deck with the building. The scenario of a structurally independent deck is a particular case when the structure is added onto the building sometime after the building has been completed. However, even when the deck is being built as part of the construction of the new building, the structure of the deck is still generally independent from the floor and wall structures of the building and generally will not share such elements with the house.

Depending on the design of the deck, porch or other external structure, its reliance upon the actual building for structural support will vary. For those structures that are built with posts or beams surrounding the entire structure and thus supporting the entire periphery of the deck, the connection to the house can be more superficial and not as robust. That is because the deck is built as a standalone structure and is merely attached to the building to present it as part of the building and to interface with a door or other opening for walking onto the deck.

However, other designs will support only the outer or side edges of the deck with posts. In such a case, the inside edges or other edges that are against the building rely upon structural support from the actual building. In those scenarios, it is much more important that the deck be connected to the house in a structurally sound way. Some current solutions for securing such a deck structure with a building still fall short in various ways.

Particularly, the structural components of the deck, such as a ledger board or other component that defines the edge of the deck that abuts against the house, are often just bolted into a counterpart component, such as a floor band board, of the house. This involves drilling properly located holes through the brick, siding or other veneer into the band board of the house. In other solutions, different anchors or brackets might be screwed or mounted to an outer surface of the house band board. The proper placement and alignment of any bolts and brackets can be an issue in such scenarios, particularly when the deck is added to the building after the building is complete. Furthermore, as might be appreciated, such mounting systems rely entirely upon the interface of the bolt, bracket or other structure with the band board for load bearing purposes. Accordingly, the load bearing features of the interface and the strength of such components are often the deciding factor in the overall load that the deck can handle.

There is thus a need for an improvement in the way that external weight bearing structures, such as decks and porches, are mounted with and supported by a building. There is further a need for an improvement in such a structural interface in both the scenario where the external structure is being built in conjunction with the supporting building, and when the external structure is later added to the supporting building. These and other needs and issues are addressed by the invention as disclosed herein.

SUMMARY OF THE INVENTION

A mounting system for mounting an external structure with a building includes and anchor frame for mounting with structural elements of a building and a bracket for coupling with the external structure. In some embodiments the anchor frame is used alone and in other embodiments the anchor frame and bracket are used. The anchor frame includes a plate element with a planar portion configured for mounting against a board of a building, such as a band board. Anchor elements extend from sides of the plate element and are configured for mounting against another board of a building, such as a floor joist. The bracket couples with the anchor frame and first and second face portions that are spaced apart. The first face portion is configured for mounting also against a board, opposite the plate element, and a bolt element couples the plate element and face portion together through the first board. The second face portion is configured for mounting with an external structure, such as a deck, thereby tying the external structure in with elements of the building.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serves to explain the invention.

DETAILED DESCRIPTION OF THE INVENTION

The present invention is directed to a mounting system for mounting an external structure with a building. In one particular use of the invention, the mounting system is suitable for mounting an external deck, porch or other structure onto a residential building, such as a house, or other building. The inventive mounting system incorporates a plurality of elements which cooperate to both anchor an external structure with internal structural elements of a building and also to provide a convenient platform for securing an external structure, such as a deck, once the mounting system is in place. The inventive mounting system may be utilized with structures that have both brick and siding veneers or other outer surfaces or veneers. The mounting system is installed, in one embodiment, at a floor interface of a building. More specifically, the mounting system is configured for mounting with structural floor elements of a building, such as band boards and floor joists. As described and illustrated herein, embodiments of the invention will be discussed with respect to mounting a deck structure to a house; however, the invention may be used with any building having certain structural elements to secure other external structures. Accordingly, the invention is not limited by the discussed exemplary usage.

The present invention provides a strong and efficient mounting system for mounting external structures to and through a building and provides an efficient installation method wherein elements of a mounting system may be put into place on and within the building and the external structure and other elements of a mounting system may be added at a later time. Features of the mounting system provide for positive location on the exterior of a building for installers. Furthermore, as noted, the mounting system is adaptable for use with a number of building exterior veneers and building structures whether having wooden framed walls, poured concrete foundation walls, or some other construction.

Figure 1:
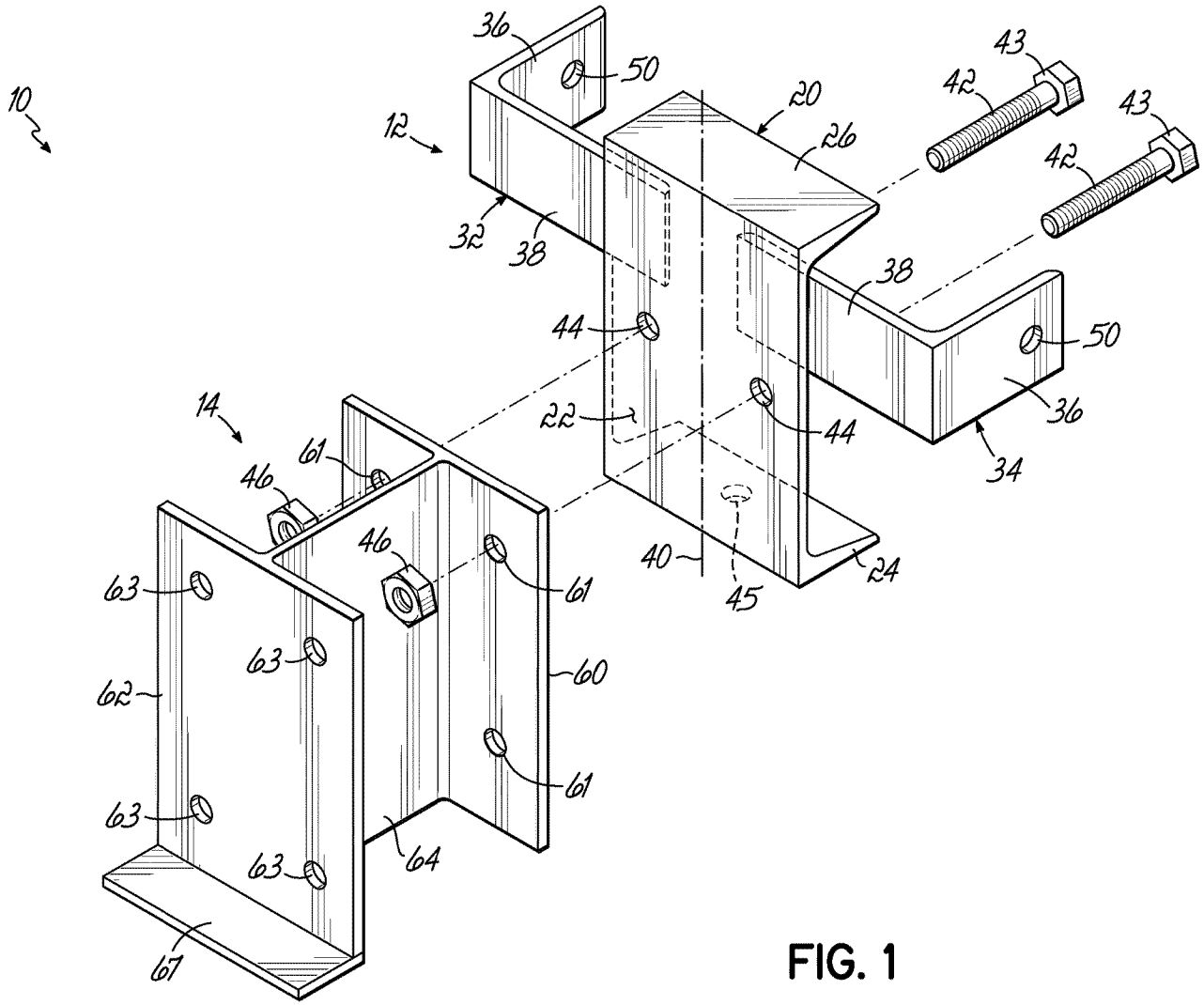
FIG. 1 is a perspective view of a deck mounting system in accordance with an embodiment of the invention.

FIG. 1 is an exploded perspective view of the mounting system 10 of the invention for mounting an external structure with the building. The mounting system 10 includes an anchor frame 12 and a bracket 14 that may be secured with the anchor frame 12 for certain installations as discussed herein. That is, for some installations, the anchor frame 12 may be utilized alone and for other installations, the anchor frame is utilized in combination with the bracket.

Figure 2A:
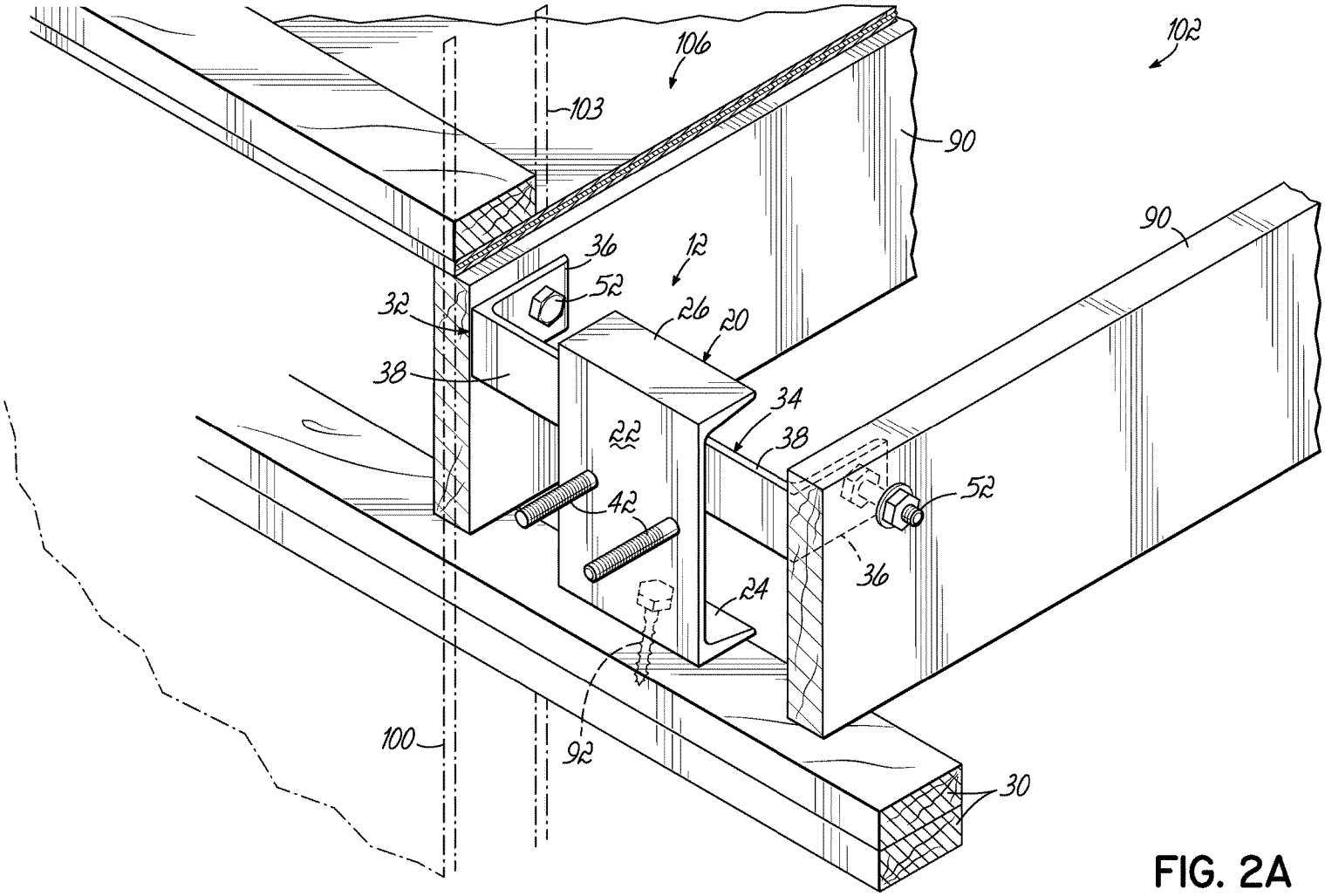
FIG. 2A is a perspective view of a component of a deck mounting system of FIG. 1 shown installed with structural elements.
Figure 2B:
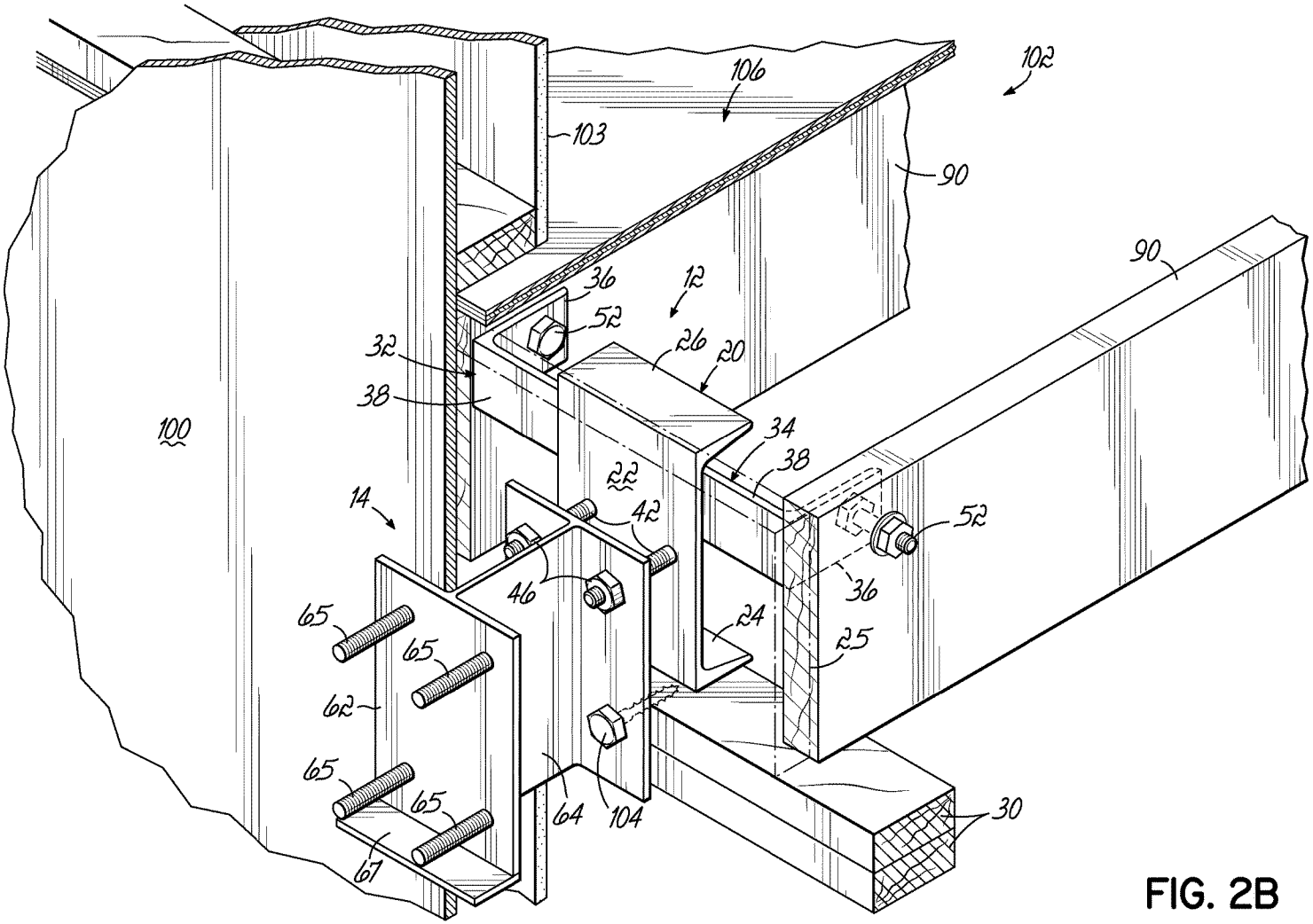
FIG. 2B is another perspective view of components of a deck mounting system of FIG. 1 shown installed with structural elements.
Figure 2C:
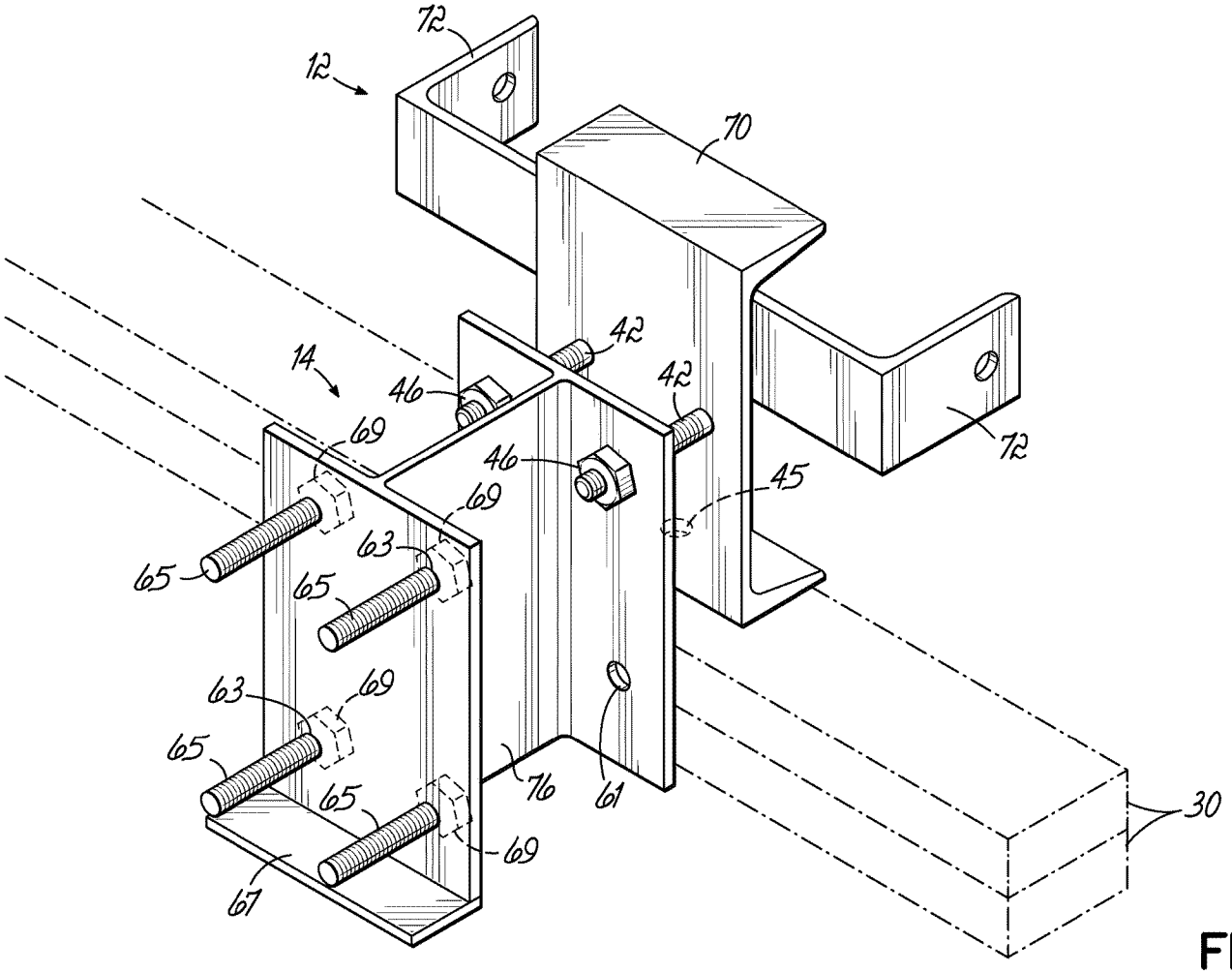
FIG. 2C a close up perspective view of components of a deck mounting system of FIG. 1 shown installed together.
Figure 2D:
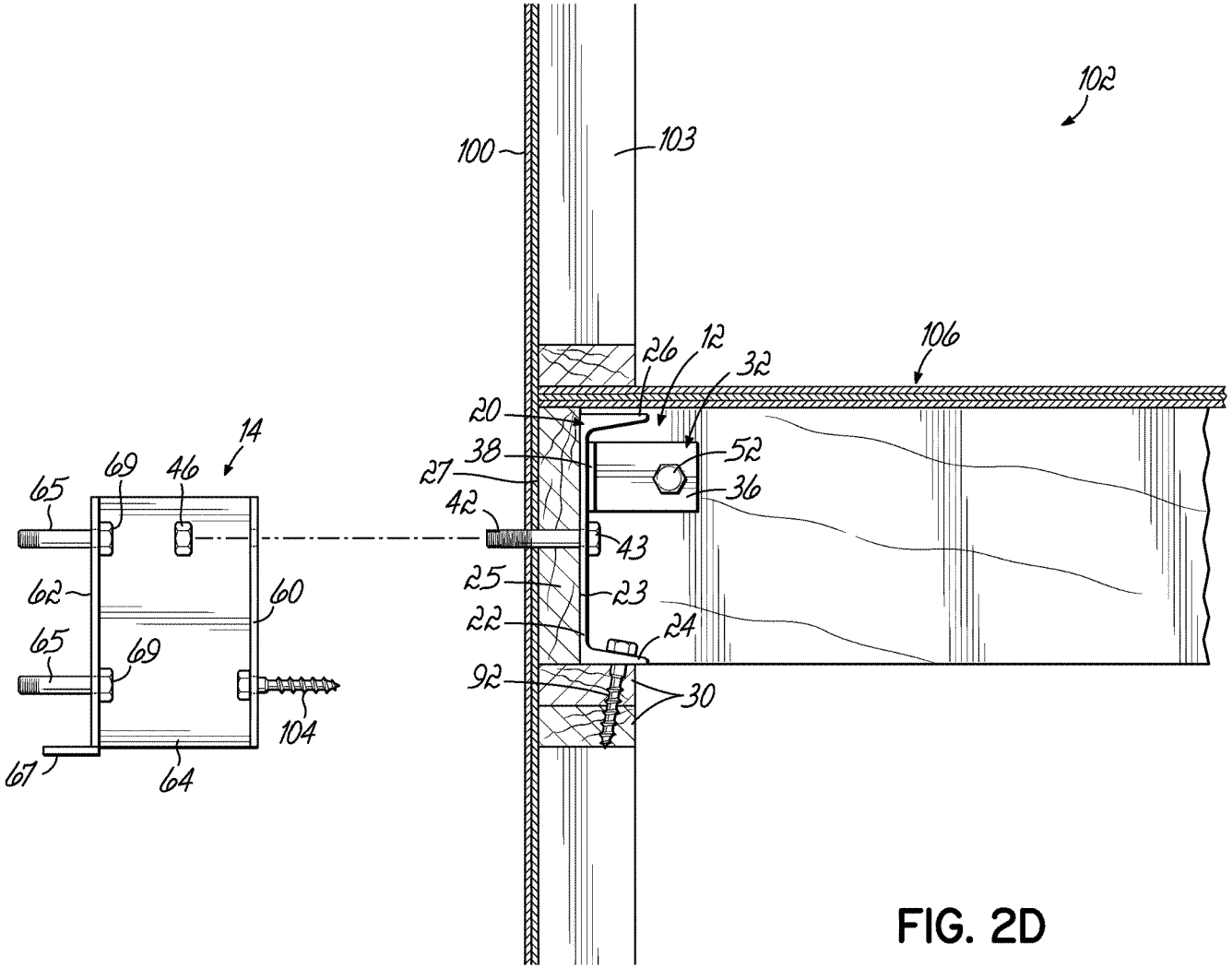
FIG. 2D a side view, in partial cross-section, of components of a deck mounting system of FIG. 1 shown installed with structural elements.

The anchor frame 12 is configured for mounting with structural elements of a building, such as floor elements, including band boards and floor joists as illustrated herein. The anchor frame includes a plate element 20 that has a planar portion 22 that is configured from mounting against a structural element, such as a band board. The planar portion 22 lies against a face 23 of the band board (see FIG. 2D). As understood by a person of ordinary skill in the art, within the flooring of a particular building, band boards are incorporated around the periphery of a floor, while floor joists span from the band boards, generally perpendicular to the band boards, and provide a platform for supporting a floor surface. Such band boards are presented proximate the exterior wall of a building as shown in FIGS. 2D-5. The planar portion 22 is configured for lying up against an interior face surface 23 of a band board when the anchor frame is installed as shown in FIG. 2D. In accordance with one embodiment of the invention, the anchor frame 12 is formed of a suitably rigid material such as steel. Although the anchor frame is discussed herein for use with a band board and perpendicular floor joist, other boards in a building that are suitably oriented might be used with the anchor frame.

For example, in the illustrated embodiment as shown in FIG. 1, the plate element 20 of the anchor frame 12 may be formed with a length of steel channel stock. In one embodiment of the invention, the plate element 20 includes one or more lip portions 24, 26 that extend generally perpendicular to the planar portion 22. For example, if the plate element 22 is formed from channel stock, the sides of the channel might form the noted lip portions 24, 26. In the illustrated embodiment, the bottom lip portion 24 extends generally perpendicular to the planar portion 22 from a bottom end of that planar portion as illustration in FIG. 1. As shown in other figures herein, including FIG. 2D, the lip portion is configured for mounting against a structural element of a building, such as one or more top plates 30 in the wall of a building for further supporting and securing the anchor frame.

The anchor frame further includes at least one anchor element and preferably a plurality of anchor elements 32, 34 that extend from the side of the planar portion 22. The one or more anchor elements 32, 34 are configured from mounting against another building structural element, such as a floor joist that is oriented perpendicular to the band board. As utilized herein, the terms such as "band board" and "joist" or "floor joists" are used for the purposes of noting common floor related structural elements of a building wherein a band board is positioned at a periphery of a floor and would be exposed to an outer wall of a building and the floor joists extend from the band board and are oriented generally perpendicular to the band board. However, the invention is not limited to a particular structural element or the names as used herein and the mounting system might be incorporated with other similarly situated, yet differently named boards and other structural elements of a building.

The anchor elements 32, 34 extend from a side of the planar portion 22 a suitable distance on opposite sides for mounting against adjacent joists or other elements that are oriented perpendicular to the band board. As such, each anchor element 32, 34 includes an anchor portion 36 that is oriented generally perpendicular to the plane of the planar portion 22 of the anchor frame 20. For proper positioning and coupling of the anchor portions 36 with plate element 20, the anchor elements 32, 34 may also include suitable span portions 38 that space the respective anchor portions 36 from a center line 40 of the anchor frame. For example, in a typical residential building, the floor joists may be spaced at 16 inches on center and thus the anchor elements 32, 34 are configured for positioning anchor portions 36 at a suitable distance for mounting against a face or face surface of a floor joist.

When installed, the anchor frame 12 is secured with the various structural elements of the building. To that end, bolt elements may be utilized as illustrated in various of the Figures herein. For example, the mounting system may include one or more bolt elements 42 that are coupled or secured with the anchor frame. In the illustrated embodiment, the bolt elements extend through the planar portion 22 and particularly extend through holes or apertures 44 formed through the plate element 20 of the anchor frame. The bolt elements extend from the planar portion 22 of the plate element 20 for securing the plate element with an external structure such as a band board. The bolt elements 42 may be threaded as illustrated in FIG. 1 and may include appropriate threaded nuts 46 that are coupled with the bolt elements 42 for proper securement. The bolt elements may be separate from the anchor frame or may be secured to the anchor frame, such as with a weld. If welded, the bolt elements may be welded on one side of the plate element and extend through apertures 44 or may be welded or secured on the other side and thus not require any apertures.

In addition to securing the plate element 20 with a building structural element, the bolt elements 42 may also secure the anchor frame 12 with bracket 14 as illustrated and discussed herein. When the plate element is secured to a band board, the anchor portions 36 of anchor elements 32, 34 are also appropriately secured with respect to structural elements, such as floor joists. To that end, the anchor elements include holes or apertures 50 formed therein for receiving other bolt elements, such as a bolts 52, as illustrated in FIGS. 2A, 2B, and 2D. The bolts 52 could be pass through threaded bolts as shown or might be lag bolts. In some embodiments, and depending on the installation, the lower lip portion 24 may include an aperture 45 to receive a lag bolt 92 to further secure the anchor frame 12. Depending upon the materials and the structural elements of the building with which the mounting system of the invention is used, the bolt elements may take a number of forms, such as traditional threaded bolts 42 and nuts which are used to couple metal elements of the mounting system together through one or more structural elements or threaded lag bolts as illustrated herein that may be screwed into suitable wooden structural elements as illustrated. Accordingly, the present invention is not limited to a particular construction of the bolt element that is used to secure the mounting system with or through certain of the structural elements of a building.

Referring again to FIG. 1, the mounting system, in certain installations, includes bracket 14 for coupling with anchor frame 12. Bracket 14 is formed with a suitably strong material such as steel and includes a first plate or face portion 60 for coupling with plate element 20 of the anchor frame 12. More specifically, as illustrated in the figures, face portion 60 is generally planar and is configured for mounting against the face surface 27 of a band board 25 of a building, opposite plate element 20, and specifically opposite the planar portion 22 of that plate element. As installed, the bracket face portion abuts against an outer face surface 27 of band board 25 (see FIG. 2D for example).

Bracket 14 further includes a second plate or face portion 62 that is spaced from the first face portion 60. The second face portion 62 is configured for mounting with an external structure, such as elements of an external deck structure as described herein. Coupling or connecting the first face portion 60 and second face portion 62 is a web or span portion 64 of the bracket that spaces the face portions from each other. As noted herein, the mounting system of the invention might be utilized with a building that includes a veneer structure, such as brick or some other material. As such, any external structure, such as a deck structure would be mounted spaced from the outside surface of structural elements of a building to address other veneer materials. To accommodate brick and other materials as illustrated in the Figures, the span portion 64 will provide a spacing between the face portions 60, 62 that will accommodate such materials. As such, the span portion 64 may have various suitable dimensions to achieve the spacing and the invention is not limited to a particular span. The face portions are secured with respective elements using bolt elements. The face portions 60, 62 of the bracket may include one or more respective apertures 61, 63 for accommodating bolt elements to secure the bracket 14 to the anchor frame 12 as well as to secure the bracket to structural elements of the building. Apertures 63 are used to connect structural elements of the external structure (e.g. a deck) with the mounting system. Such bolt elements 65 as used with face portion 62 may be loose or may be fixed with the bracket, such as by welding. As noted with anchor frame, if the bolts 65 are welded they might be welded on one side and pass through apertures 63 or might be welded to the other side and not have to pass through apertures (see FIG. 2B-2D). As shown in FIG. 1, certain of the apertures 61 in face portion 60 may receive the bolt elements 42 for coupling the anchor frame 12 and bracket 14. Other apertures 61 of face portion 60 and apertures 63 of face portion 62 may accommodate other bolt elements. For example, lag bolts might be screwed into suitable structural elements of the building or external structure as described.

In accordance with one embodiment of the invention, the various planar components and portions of the steel anchor frame 12 and bracket 14 might be welded together with separate steel plates to form the invention. In another embodiment, the anchor frame 12 and bracket 14 may be fabricated from steel elements, such as channel elements, angle elements, and H-beam elements. Referring to FIG. 2C the anchor frame 12 might be formed by a steel channel element 70 such as a C-channel element. Such a C-channel element can be used to provide the planar portions 22 and lip portions 24, 26 of the anchor frame 12 as disclosed. Angle elements 72 may then be welded appropriately to C-channel elements 70 at interfaces to form the anchor frame and anchor elements. The bolt elements 42 extend through apertures 44 in the C-channel element. In one embodiment, the bolt heads 43 of the bolt elements may be appropriately welded with one side of the planar portion 22 formed in order to project forward through apertures for engaging with a band board and bracket 14 and to secure the bolt elements as part of anchor element 12.

For forming bracket 14, an H-beam element 76 might be implemented to provide first and second face portions 60, 62 and a spanning portion 64 as discussed herein. Appropriate holes or apertures 61, 63 are formed in the H-beam element 76 for receiving bolt elements 42, 65 or one or more lag bolts 104. As illustrated in FIG. 2C, threaded bolts 65 might be utilized in the second face portion 62 and the heads 69 of the bolts 65 might be welded to the second face portion 62 to present bolt elements to be secured with structural elements of an external structure, such as structural elements of a deck. As noted, one or more apertures 61 might also be formed below those apertures receiving the bolts 42 for receiving other bolt elements, such as a lag bolts to further secure the anchor frame with structural elements of a building. In that way, the bracket is secured both to the anchor frame and then separately to a structural element of the building. A shelf 67 is formed on face portion 62. The shelf might be formed by welding a rectangle steel section to the lower edge of face portion 62 of the bracket. As noted herein, shelf 67 provides support for a ledger board or other element of the deck.

In one exemplary embodiment of the invention, the plate element 20 of the anchor frame is approximately 6 inches by 9 inches (6"×9"). The anchor elements span to either side to form a total span of approximately 14¼" and are approximately 2½" high. The face portions 60, 62 are also approximately 6"×9" and the span portion 64 provides a span distance between the face portions of approximately 6". The thickness of the components 20, 32, 34, 60, 62, 64 of the anchor frame and bracket may be approximately ¼" thick. Of course, the invention is not limited to specific dimensions of the various components.

Referring now to FIG. 2A, the anchor frame 12 is illustrated mounted with various structural elements of a building to secure the anchor frame with the building. More specifically, structural elements such as floor joists 90 are shown positioned on top plates 30 that are positioned at a wall of the building. The floor joists 90 span out for forming the floor sub-structure. In FIG. 2A, the band board 25 is shown removed for illustrating the anchor frame 12 in position. However, shown in FIG. 2D, the band board would generally be positioned against the planar portion 22 of the plate element 20 of the anchor frame. As shown in FIG. 2A, plate element 20 includes lip portion 24 that rests on the top plates 30 at installation. The anchor elements 32, 34 span outwardly from the plate element 20 for coupling with the floor joists 90. For some installations, wherein wooden top plates 30 are part of the structural elements of the building, a bolt element such as lag bolt 92 is screwed into the top plates through aperture 45 in the anchor frame 12 (see FIG. 1). In other installations, such as those shown in FIGS. 3B and 4B, a lag bolt 92 would not be utilized and the lip portion 24 would simply rest upon a suitable building structural element such as a top plate or concrete foundation.

To secure the anchor elements 32, 34, bolts 52 are used and are passed through apertures 50 formed in the anchor elements and may be passed through the anchor board, such as the floor joist. Specifically, the anchor elements include anchor portions 36 that are oriented generally perpendicular to the planar portion 22 of plate element 20. As such, when the plate element 20 is oriented against the interior face 23 of band board 25, the appropriately spaced anchor portions 36 of the anchor elements will lie against a face surface of the floor joists 90 (see FIG. 2A, 2B, 2D). The anchor portions may then be appropriately secured with bolt elements, such as bolts 52. In that way, as shown in FIG. 2A, the anchor frame may be secured with the structural elements inside of a building and behind board 25. As will be appreciated, depending upon the dimensions of the anchor frame as well as the placement of the various bolt elements 42, in order to place anchor frame against band board 25, holes will have to be marked and drilled or otherwise made in the band board 25 so that the bolt elements 42 may pass therethrough. This would have to be done before seating the anchor frame, particularly in those scenarios where the bolts 42 are welded to the anchor frame. Furthermore, there might be other external layers 100 on the outside of the band board 25 and on the outside of the building, and thus holes would have to be formed therethrough as well (see FIG. 2D). As may be appreciated, a template might be utilized for drilling the appropriate holes through the band board 25 and other layers 100 so that the anchor frame may be properly mounted against the band board and floor joists.

Figure 5:
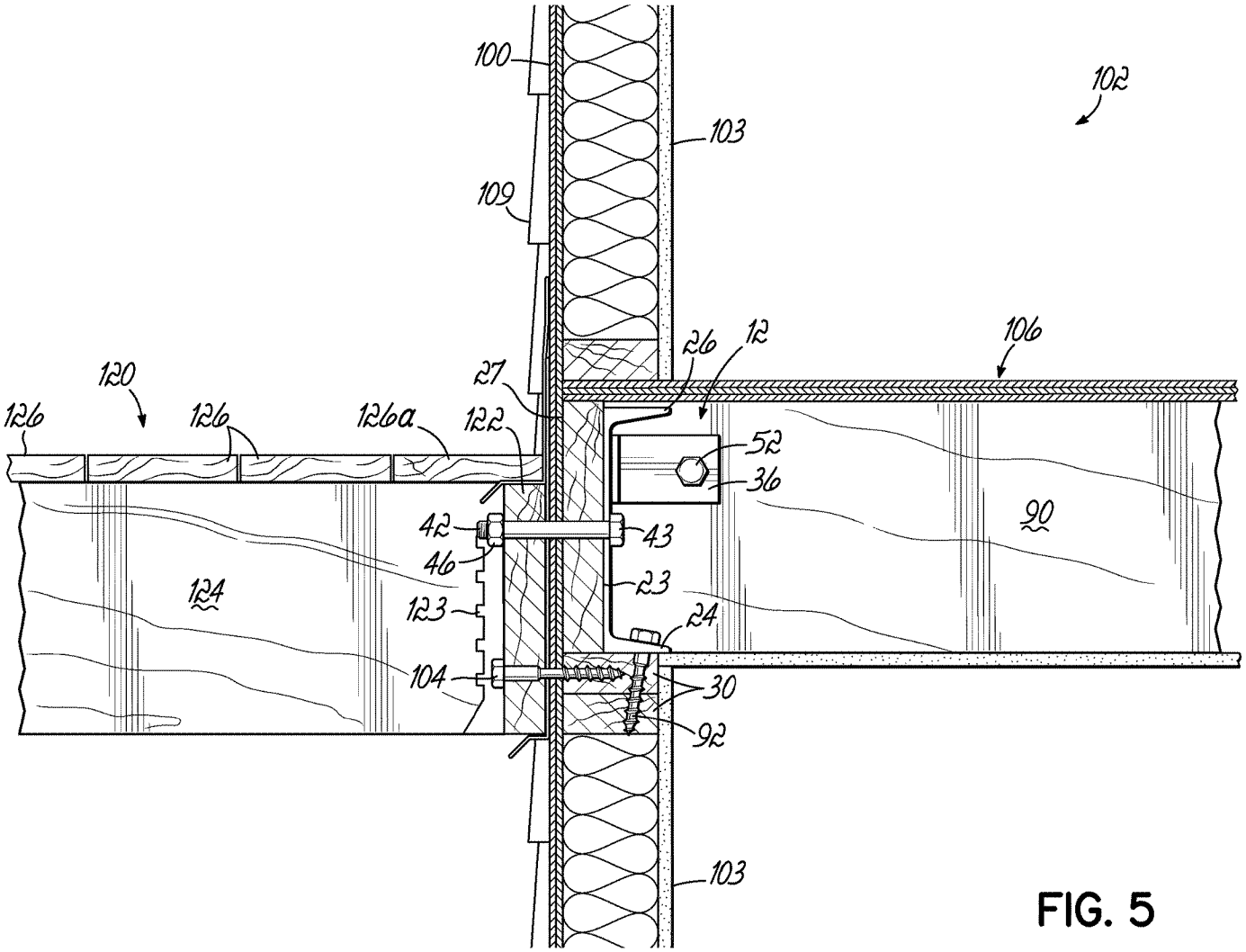
FIG. 5 is a side view, in partial cross-section, of a deck mounting system of the invention in another building installation

As illustrated herein, in some installation scenarios, the mounting system may only have to utilize the anchor frame 12 for securing an external structure, such as a deck. For example, the configuration as illustrated in FIG. 5 only utilizes anchor frame 12. However, for various other installations, the mounting system utilizes the bracket 14 that couples with the anchor frame 12 for the mounting system. Referring to FIGS. 2B and 2D, once the anchor frame has been installed, the various bolt elements 42 are presented at an outer surface of the board 25 and building 102. Bracket 14 may then be secured with the anchor frame 12 and the band board 25 through bolt elements 42 and other bolt elements 104. Specifically, the first face portion 60 is configured for being mounted against surface 27 of band board 25 (and intervening layers 100) as shown in FIG. 2D. As such, as illustrated in FIG. 2B, when the bracket is mounted, the first face portion is positioned opposite the plate element 20 and specifically opposite the planar portion 23 of the plate element and on the other side of the board 25. As discussed herein, reference to mounting against the band board, against a floor joist, or against some other element does not require that certain portions of the mounting system actually contact such band boards, floor joists, or other structural elements. That is, there may be other layers, such as insulating layers, waterproof layers, and other suitable materials or layers against those building structural elements and thus between the structural elements and components of the mounting system. As such, when a portion or element of the mounting system is mounted against such a structural element, it includes a scenario of mounting against other additional layers that overlie a face surface of the structural element. Referring to FIG. 2D, the first face portion 60 of the bracket mounts against band board 25 through the additional layers 100 as noted. To secure bracket 14 with anchor frame 12, the bolt elements 42 extend through appropriate apertures 61 in the first face portion as shown in FIGS. 2B and 2C, and the bolt elements are secured with the appropriate nuts 46. Accordingly, the mounting system of the invention captures the board 25 between elements of the mounting system to tie the system into the building structure. As such, load of the deck or other structure is transferred to the entire board and not just to anchors or bolts extending into the board. Furthermore, as discussed herein, the mounting system also ties in directly to the floor joists for further load bearing and support.

In one embodiment of the invention the bolt elements 42 extend from or through the planar portion of the plate element 20 generally in the middle of the plate element as shown in FIG. 2D. Depending upon the positioning of the apertures 61, the first face portion 60 and bracket 14 may be offset slightly below the position of the anchor frame 12 in the building. As such, the bracket 14 is positioned vertically lower on the outside of building 102 than the anchor frame is inside the building. Other apertures 61, formed within the first face portion 60 at positions below those apertures 61 that receive the bolt elements 42, align with other structural elements, such as the top plates 30 inside the building (see FIG. 2D). To that end, to further secure bracket 14 with the structural elements of the building and independently of anchor frame 12, bolt elements such as lag bolts 104 may be screwed through the lower apertures 61 in the first face portion and screwed into the top plates 30 as shown in FIG. 2B. Generally, the apertures 61 within bracket 14 and aperture 45 within the lip portion 24 are positioned so that the lag bolts 104 do not interfere with and lag bolts 92 securing the anchor frame with top plates 30 as illustrated in FIGS. 2A and 2D. Once secured, the bracket 14 is thus tied to and supported by the structural elements of the building including the band board 25 and floor joists 90.

Once the bracket 14 is secured with anchor frame 12 and thereby with structural elements of the building, the second face portion 62 is exposed and spaced from the first face portion and presents a plurality of other bolt elements 65 externally on the building. Those bolt elements 65 are then secured to structural elements of an external structure, such as the ledger board or other similar board or element of a deck structure as illustrated herein. Those bolt elements 65 may be appropriately threaded and secured with threaded nuts similar to the bolt elements 42 and nuts 46. As noted, the bolt elements might be fixed to the bracket and the heads 69 or other portions of the of the bolt elements 65 might be welded to the second face portion 62.

The mounting system may be positioned along the side of a building at various positions as dictated by the dimension of the deck or other external structure. That is, several mounting systems of the invention will be used to support a structure in most installations. For example, a mounting system 10 as disclosed might be positioned every 2 to 5 feet along a deck for proper support.

FIGS. 3A-3B, 4A-4B, and 5 illustrate several installation scenarios for the mounting system of the invention. As noted, the mounting system may be utilized with walls that are essentially wood frame walls, as well as poured concrete foundation walls and may be utilized with buildings that have veneer structure such as brick or siding. Once one or more of the mounting systems are installed, the various structural elements of an external structure, such as a deck may be mounted to the exposed elements and portions of the mounting system to secure the external structure with the building.

Figure 3A:
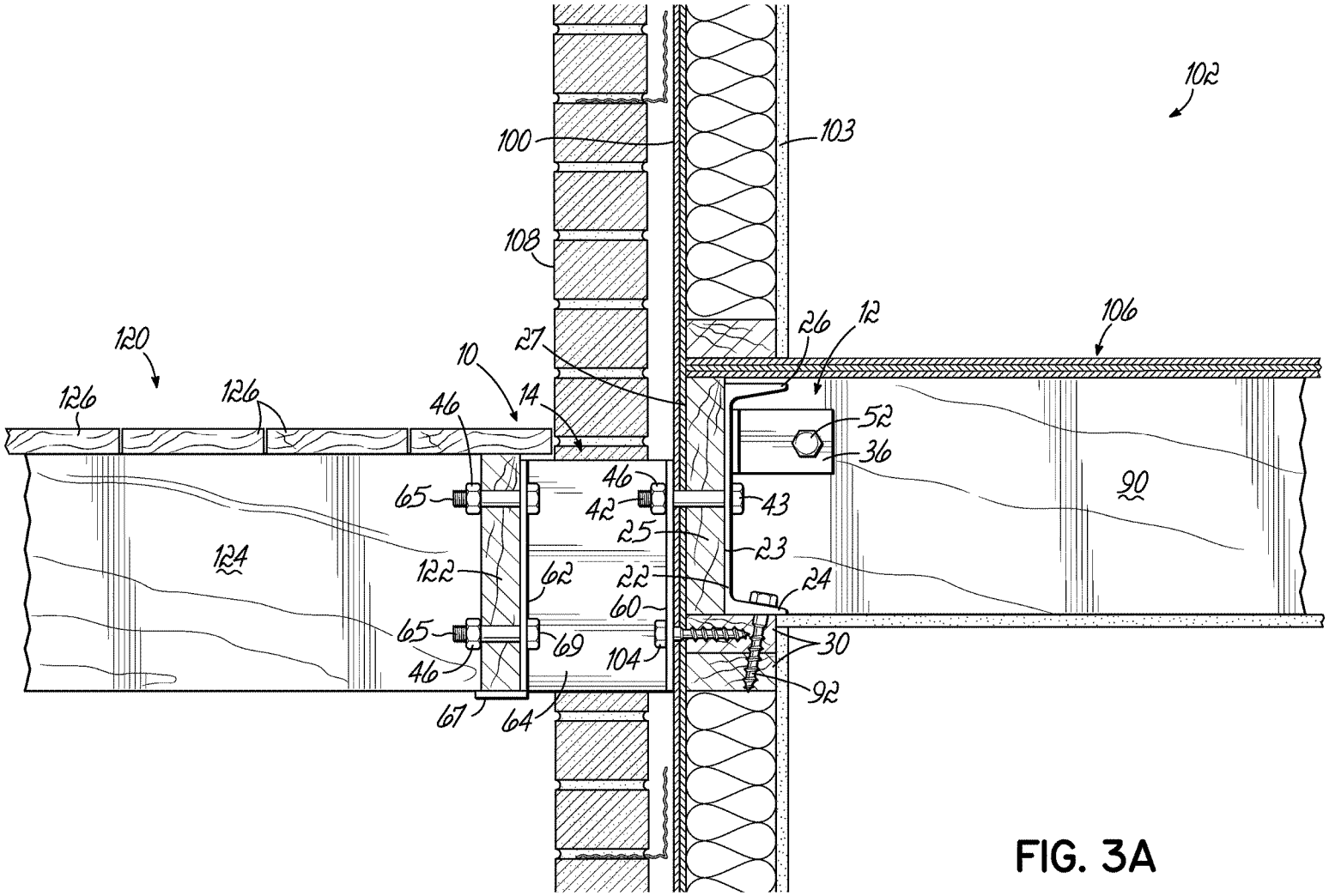
FIG. 3A is a side view, in partial cross-section, of a deck mounting system of the invention in a building installation.

Referring to FIG. 3A, the mounting system 10 of the invention as illustrated used with the building 102. The floor structural elements 106 are mounted on a wood frame wall 103 and the building includes a brick veneer 108. To that end, the anchor frame 12 is secured to band board 25 and to floor joists 90 as well as to top plates 30 with the appropriate bolt elements 42, 52, and 92. Bracket 14 is then secured against band board 25 and with anchor frame 12 through bolts 42 and is secured with structural elements of the building, such as top plates 30, through one or more bolt elements 104. The bracket 14 then presents bolt elements 65 at an outside surface of the building. Generally, the mounting system is installed while the interior band board surface and floor joists are exposed. Also, the installation is generally before the outer veneer is installed on the building. As such, brackets 14 are exposed. The brick veneer may then be installed or applied. The bracket 14, and particularly the span portion 64, provides for suitable spacing for building the brick veneer 108 and bricks from that veneer may be mounted on either side of the span portion 64 between the two face portions 60, 62 of the bracket. As such, a significant portion of the bracket is also visually hidden after final construction while still providing a strong securement of a deck to the building 102.

An external structure, such as a deck 120 may then be mounted to building 102 in accordance with the invention. More specifically, an appropriate external structural element, such as a ledger board 122 of the deck 120 is secured to bracket 14 with bolt elements 65. Appropriate holes are formed in the deck ledger board 122 to receive bolt elements. Such holes are drilled at spacing intervals along the ledger board according to the position of the exposed brackets. In accordance with another feature of the invention, the bracket 14 includes a shelf 67 which receives the lower edge of the ledger board 122 and further provides bracket support for the band board in addition to the bolt elements 65. Ledger board 122 may then be appropriately coupled with floor joists 124 to then receive floor boards 126 of the deck 120. In that way, the deck 120 or other external structures are secured directly to internal structural elements of the building, including the band board 25 and floor joists 90 to provide a robust securement and mounting of the external deck 120.

Figure 3B:
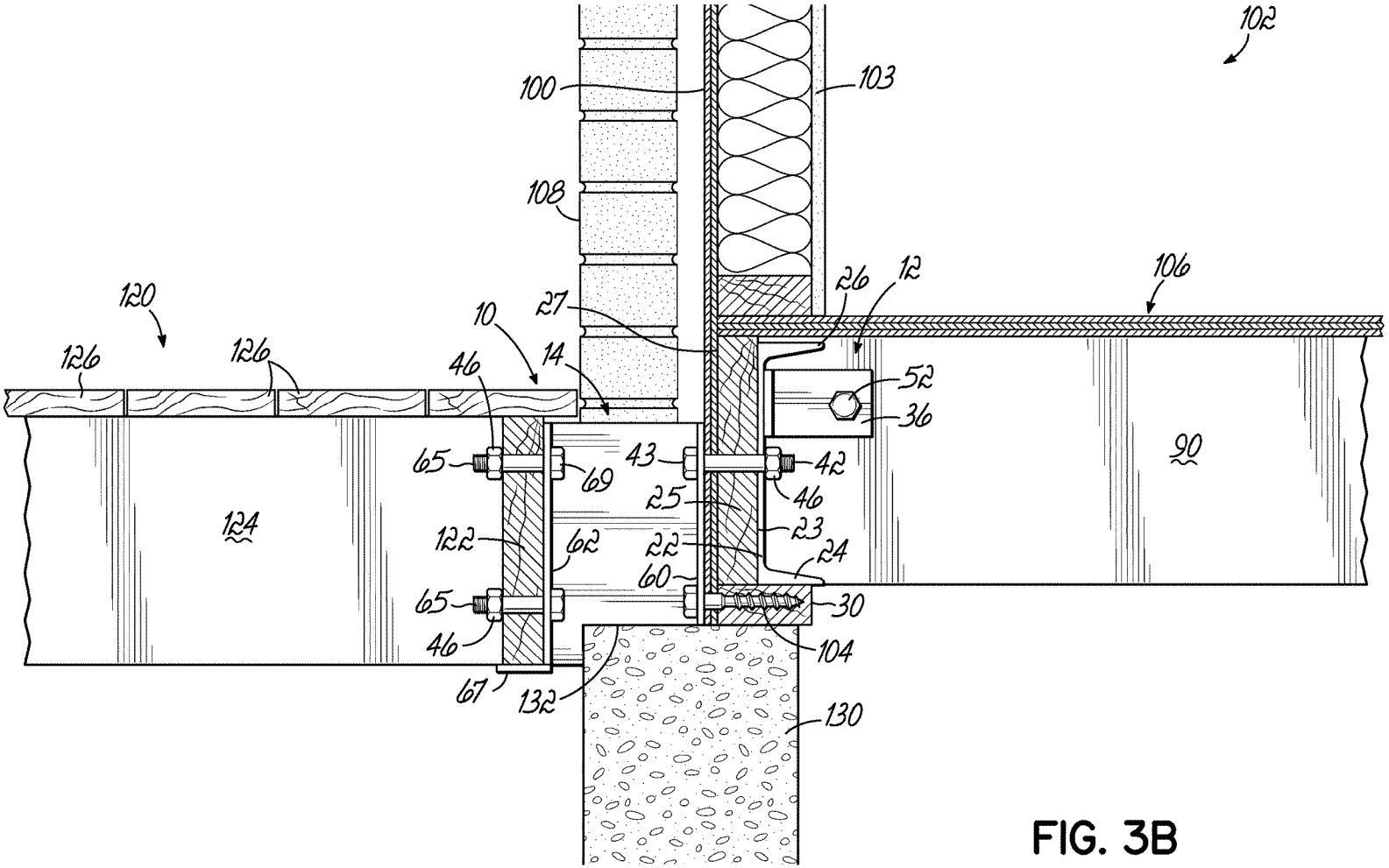
FIG. 3B is a side view, in partial cross-section, of a deck mounting system of the invention in another building installation

FIG. 3B provides a somewhat similar building scenario of a building 102 including a brick veneer 108 and an external deck 120 and, as such, like numerals are utilized. However, the building 102 includes a concrete foundation wall rather than a wood stud wall. As such, the anchor frame is mounted to sit on top of the foundation wall. Referring to FIG. 3B, the anchor frame 12 is secured in a similar fashion to the scenario of FIG. 3A, as discussed herein. However, in such scenarios, the number of top plates 30 may limit the thickness of wood structural elements above the foundation wall 130. As such, anchor frame 12 may only rest on the face plate or plates 30 and may not be specifically secured thereto, such as with bolt element 92. However, bracket 14 is similarly secured to the anchor frame and building 102 and to structural elements of deck 120.

Figure 1A:
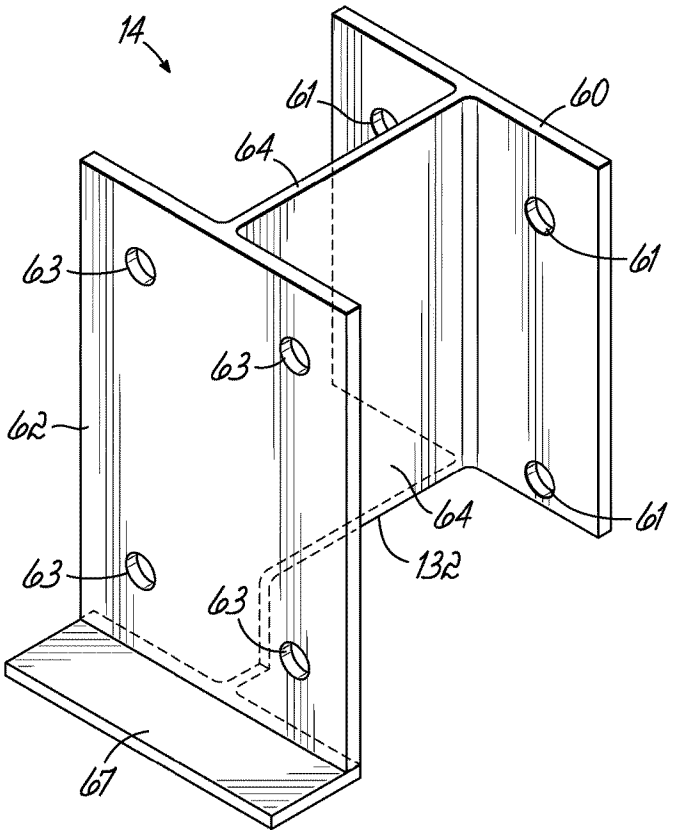
FIG. 1A is a perspective view of a component of a deck mounting system in accordance with another embodiment of the invention.

In the embodiment of FIG. 3B, due to the vertical offset of bracket 14 from the anchor frame 12 and depending upon the height of any top plates 30, bracket 14 may include a notch 132 forward therein for accommodating the foundation wall 130. In such a scenario, the brick veneer 108 rests on wall 130. FIG. 1A illustrates a version of bracket 14 that includes the notch 132. Of course, if suitable vertical spacing is provided by top plates 30 to space anchor frame sufficiently above the foundation wall 130, it may not be necessary to use a notched bracket. As illustrated, the notch may generally affect the size of face portion 60 relative to face portion 62. However, the bracket of 14 and anchor frame operate the same as disclosed herein.

Figure 4A:
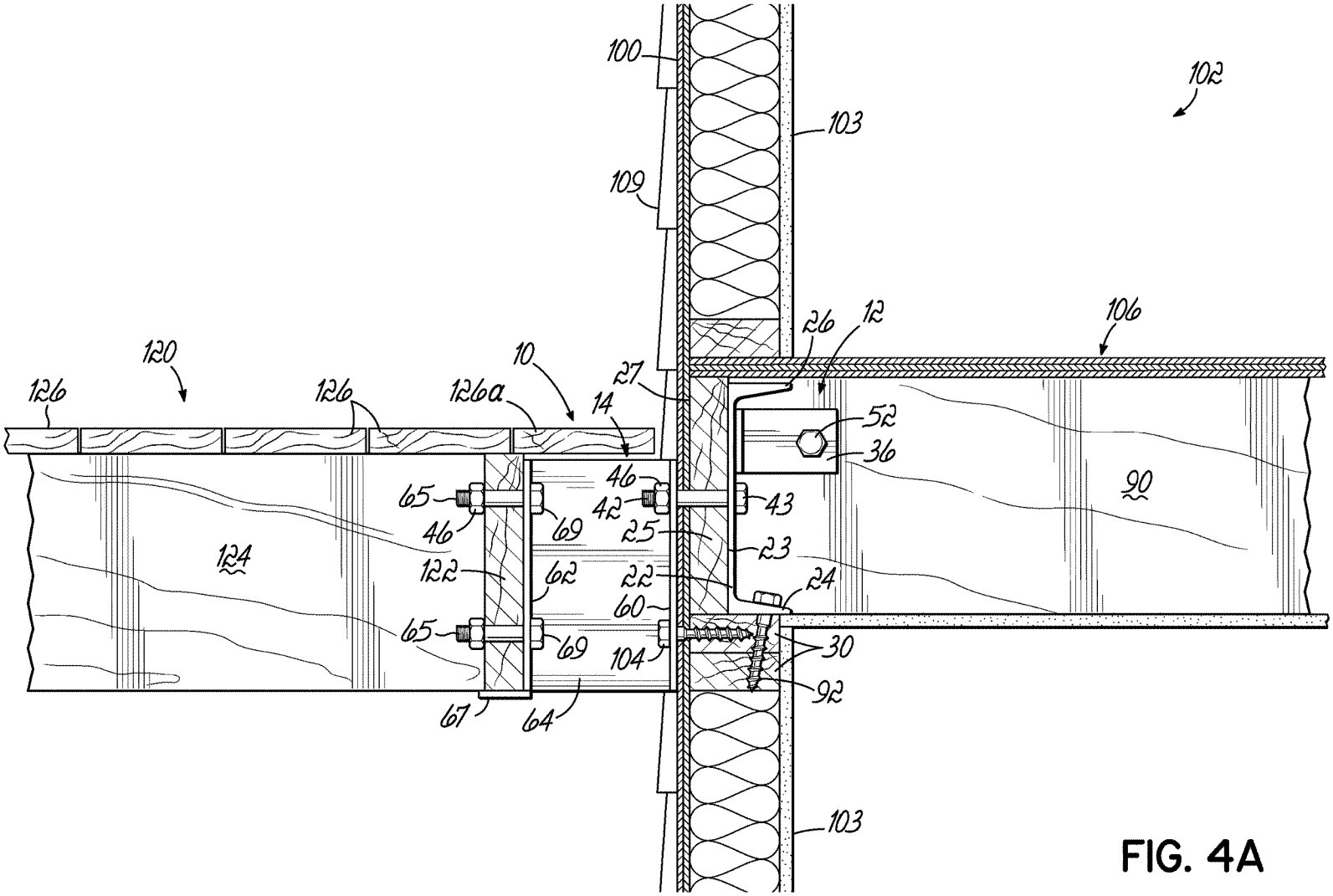
FIG. 4A is a side view, in partial cross-section, of a deck mounting system of the invention in another building installation

Turning to FIG. 4A, the use of the mounting system of the invention on a building 102 that incorporates siding 109 rather than a brick veneer is illustrated. The building 102 includes a wood stud wall 103 similar to the scenario of FIG. 3A and the anchor frame is appropriately secured both to the band board 25, floor joists 90, and top plates 30 of the stud wall 103. Similarly, bracket 14 is secured in a similar fashion as illustrated in FIG. 3A. Because of the use of siding 109, which has a thinner profile than a brick wall, a spacing is provided by the bracket that is associated with the span portion 64 of bracket 14. To that end, floor boards 126 of the deck 120 may span that distance between the two face portions 60, 62 of the bracket. Specifically, floor board 126*a* is illustrated spanning that distance. For support of that floor board, blocking structures (not shown) might be utilized on the external surface of a building 102 between sequential mounting systems in order to provide support for such boards 126*a* that span the distance provided by the bracket.

Figure 4B:
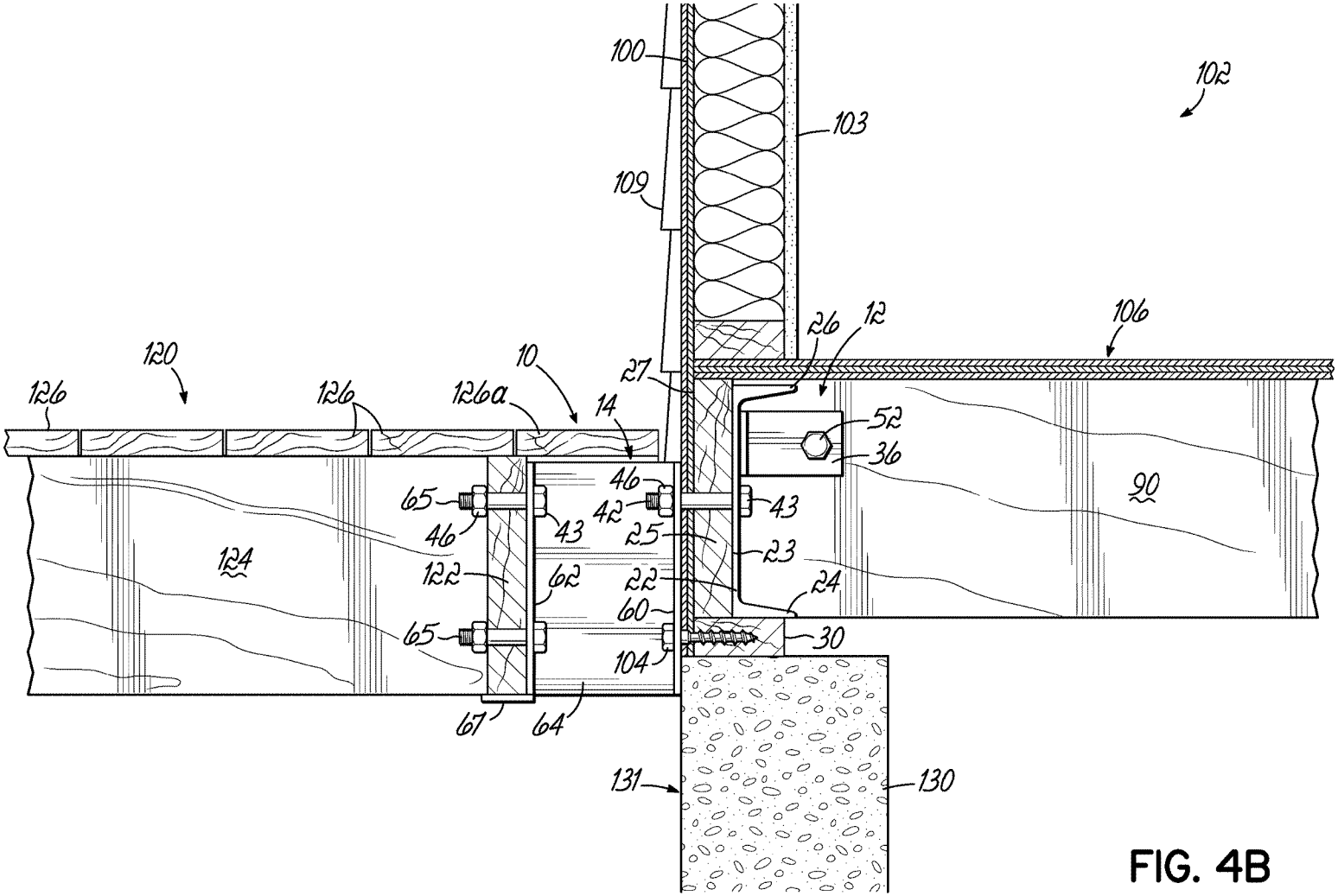
FIG. 4B is a side view, in partial cross-section, of a deck mounting system of the invention in another building installation.

FIG. 4B illustrates a similar installation of the mounting system of the invention on a building 102 including siding 109. However, a foundation wall 130 rather than a stud wall 103 is utilized. Because there is no need to support a portion of the brick veneer on the foundation wall 130, the band board 25 and floor joists structures 90 may extend out to the outer face 131 of the foundation wall as illustrated in FIG. 4B. As such, bracket 14 is mounted generally flush to the face surface 131 of the foundation wall and does not need to be notched to rest on the foundation wall. Other than that difference, the anchor frame 12, bracket 14, and elements of deck 120 are mounted similar to the installation as illustrated in FIG. 3B, for example.

FIG. 5 illustrates a scenario wherein the building 102 incorporates a siding veneer 109 similar to the installation of FIGS. 4A and 4B. However, in order to avoid the span distance provided by bracket 14 and the span portion 64 of that bracket, the mounting system as installed in FIG. 5 only incorporates the anchor frame 12 of the system. In such a scenario the ledger board 122 is mounted directly to the other side of the band board rather than to the second face portion 62 of bracket 14. That is, bolt element 42 extends through the ledger board 122 and band board 25 and bolt element 104 is screwed through the ledger board 122 and into the top plates 30. As may be appreciated, both of the bolt elements 42 and 104 may need to be extended in length to accommodate the thickness of the ledger board 122 versus the generally thinner face portion 60 of the bracket 14. The installation of FIG. 5 illustrates a joist hanger element 123, and similar joist hanger elements may be incorporated within the deck 120 of the other installations as shown in the figures. As such, the joists bracket 123 is not considered part of the invention but is a known way of coupling joists 124 with the ledger board 122 of the deck 120.

While the present invention has been illustrated by a description of various embodiments and while these embodiments have been described in some detail, it is not the intention of the inventors to restrict or in any way limit the scope of the appended claims to such detail. Thus, additional advantages and modifications will readily appear to those of ordinary skill in the art. The various features of the invention may be used alone or in any combination depending on the needs and preferences of the user.

What is claimed is:

1. A mounting system for mounting an external structure with a building comprising:

an anchor frame configured for mounting with structural elements of the building, the anchor frame including:

a plate element having a planar portion with opposing sides, the planar portion configured for mounting against a first board of the building;

an anchor element extending from each of the opposing sides of the plate element, the anchor elements each include an anchor portion oriented substantially perpendicular to the planar portion of the plate element, the anchor elements configured for mounting against respective second and third boards of the building that are positioned at either side of the plate element and are each oriented perpendicular to the first board;

a plurality of bolt elements for securing the anchor frame with the building, at least one bolt element of said plurality extending through the planar portion of the plate element for engaging the first board and at least another bolt element of said plurality extending through each of the anchor elements for engaging the respective second and third boards and for securing the anchor frame with the respective boards.

2. The mounting system of claim 1 further comprising the plurality of bolt elements extending through the planar portion of the plate element for securing the plate element.

3. The mounting system of claim 1 wherein the plate element is configured for mounting with a band board of the building.

4. The mounting system of claim 1 wherein the anchor elements are configured for mounting with floor joist boards of the building.

5. The mounting system of claim 1 wherein the plate element includes a lip portion extending substantially perpendicular to the planar portion from a bottom end of the planar portion, the lip portion configured for mounting against a respective said structural element of the building.

6. The mounting system of claim 1 further comprising a bracket for coupling with the anchor frame, the bracket including:

a first face portion configured for mounting against the first board, opposite the plate element planar portion, the bolt element extending through the planar portion of the plate element and the first face portion of the bracket for securing the bracket with the plate element on either side of the first board;

a second face portion spaced from the first face portion, the second face portion configured for mounting with the external structure.

7. The mounting system of claim 6 further comprising a span portion connecting the first and second face portions of the bracket in a spaced relationship.

8. The mounting system of claim 6 further comprising a shelf extending from the second face portion and substantially perpendicular to the second face portion.

9. A mounting system for mounting an external structure with a building comprising:

an anchor frame configured for mounting with structural elements of the building, the anchor frame including:

a plate element having a planar portion with opposing sides, the planar portion configured for mounting against a first board of the building;

an anchor element extending from each of the opposing sides of the plate element, the anchor elements each include an anchor portion oriented substantially perpendicular to the planar portion of the plate element, the anchor elements configured for mounting against respective second and third boards of the building that are positioned at either side of the plate element and are each oriented perpendicular to the first board;

a bracket for coupling with the anchor frame and including:

a first face portion configured for mounting against the first board, opposite the plate element;

a bolt element configured for coupling the plate element and face portion together through the first board for securing the bracket with the plate element on either side of the first board;

a second face portion spaced from the first face portion, the second face portion configured for mounting with the external structure.

10. The mounting system of claim 9 further comprising a plurality of bolt elements configured for coupling the plate element and face portion together through the first board.

11. The mounting system of claim 9 wherein the plate element is configured for mounting with a band board of the building.

12. The mounting system of claim 9 wherein the anchor element is configured for mounting with a floor joist board of the building.

13. The mounting system of claim 9 further comprising a span portion connecting the first and second face portions of the bracket in a spaced relationship.

14. The mounting system of claim 9 further comprising a shelf extending from the second face portion and substantially perpendicular to the second face portion.

15. The mounting system of claim 9 wherein the plate element includes a lip portion extending substantially perpendicular to the planar portion from a bottom end of the planar portion, the lip portion configured for mounting against a respective said structural element of the building.

16. The mounting system of claim 9 further comprising a plurality of said bolt elements for securing the anchor frame with the building, at least one bolt element of said plurality configured for extending simultaneously through the planar portion of the plate element and through the first face portion, and at least another bolt element of said plurality extending through each of the anchor elements for securing the mounting system with the respective boards.

* * * * *